US005284427A

United States Patent [19]

Wacker

[11] Patent Number: 5,284,427

[45] Date of Patent: Feb. 8, 1994

[54] PREHEATING AND COOLING SYSTEM FOR A ROTARY ENGINE

[76] Inventor: Roland W. Wacker, 36 Hollywood Ave., Los Gatos, Calif. 95032

[21] Appl. No.: 59,977

[22] Filed: May 5, 1993

[51] Int. Cl.[5] ..... F01C 21/04

[52] U.S. Cl. ..... 418/83; 417/369; 418/36; 418/86

[58] Field of Search ..... 418/36, 83, 85, 86; 417/366, 369, 370, 423.8

[56] References Cited

U.S. PATENT DOCUMENTS

| | | | |
|---|---|---|---|
| 3,572,984 | 3/1971 | Jones | 418/83 |
| 4,168,941 | 9/1979 | Rettew | 418/83 |
| 4,982,564 | 1/1991 | Hines | 60/39.55 |
| 5,016,436 | 5/1991 | Belcher et al. | 60/264 |
| 5,111,662 | 5/1992 | Nicolin et al. | 60/655 |
| 5,146,693 | 9/1992 | Dottor et al. | 34/77 |
| 5,147,191 | 9/1992 | Schadeck | 418/36 |

FOREIGN PATENT DOCUMENTS

| | | | |
|---|---|---|---|
| 0004888 | 1/1986 | Japan | 418/86 |

*Primary Examiner*—Richard A. Bertsch
*Assistant Examiner*—Charles G. Freay
*Attorney, Agent, or Firm*—Schneck & McHugh

[57] ABSTRACT

A pressurized fluid-driven engine includes an engine chamber defined by a housing having one or more endplates which include serpentine channels for the flow of temperature-regulating fluid. Preferably, each endplate has a pair of channels that each has a scroll pattern. The temperature-regulating fluid may be the same fluid that is employed in driving the engine. The fluid is utilized both to preheat the engine and to cool the engine during use. The engine may be coupled to a generator for the production of electrical energy.

17 Claims, 6 Drawing Sheets

PREHEATING AND COOLING SYSTEM FOR A ROTARY ENGINE

TECHNICAL FIELD

The present invention relates generally to fluid-driven engines and more particularly to systems for increasing the efficiency of such an engine.

BACKGROUND ART

Major strides have been made in reducing the need for oil and natural gas to satisfy the world's energy requirements. For example, solar energy plays a small but increasingly important role in supplying power for the operation of electrical devices.

In addition to utilizing alternative sources of energy, the dependency on oil and natural gas can be lessened by reducing waste. A waste reduction may be in the form of increasing the efficiency of a device or in the form of utilizing by-products of the device. A water heater of a major hotel is one example of a device which produces by-products that can be utilized. Heating the water to a desired temperature creates pressurized steam. The pressurized steam can be employed to drive a motor for the generation of electrical energy. U.S. Pat. No. 5,147,191 to Schadeck teaches a vapor-driven rotary engine that can be driven by steam from a hotel boiler and coupled to a generator for conversion to electrical energy, whereafter hotel lights can be operated.

While vapor-driven rotary engines may be used in a capacity to conserve energy, any inefficiencies of the engine will limit the degree of conservation.

It is an object of the present invention to provide a rotary engine that promotes both energy efficiency and fuel conservation.

SUMMARY OF THE INVENTION

The above object has been met by a pressurized fluid-driven engine that utilizes a phase of the fluid that drives the engine to provide preheating and cooling for an increase in efficiency. By utilizing the same fluid to both drive and thermally regulate the engine, fuel conservation is achieved. Moreover, the preheating and cooling increases the efficiency of the engine and reduces engine wear, so that the useful life of the engine is increased.

The fluid-driven engine includes a housing having an engine compartment. A source of a pressurized fluid, such as steam, is coupled to the housing to drive a rotatable assembly. For example, the fluid may be directed to rotate pistons coupled to a shaft. Coupled to the housing is one or more endplates that have a channel extending therethrough for the flow of temperature-regulating fluid. Preferably, the channel has a serpentine configuration to maximize surface contact for conducting thermal energy from the engine. Concentric scroll-shaped patterns in endplates of the engine chamber are preferred.

Preheating the engine reduces wear. If the engine is driven by steam, the steam may be used as the preheating fluid. Alternatively, the liquid that is acted upon in order to produce the steam may be employed, e.g. heated water.

During normal operation of a standard rotary engine, the engine may rise to a temperature that promotes wear and inefficiency. The coolant that is used in the present invention to regulate temperature may be the exhausted fluid from the engine chamber, since the fluid will undergo some thermal loss in traveling through the chamber. Another alternative is to divide the path of the drive fluid to direct a portion of the fluid to the channels in the endplates. The division may be at an adjustable valving mechanism that is automatically varied to ensure a substantially constant temperature at the engine compartment. For example, the valving mechanism may be responsive to a thermostat connected to the housing that defines the engine chamber. Detection of an increase in temperature at the thermostat will then result in an increase in the flow rate of fluid through the channels in the endplates.

Yet another alternative for providing a coolant is to utilize the fluid that is acted upon to produce the pressurized drive fluid. For example, a water heater that produces the pressurized steam may be connected to the channels of the endplates to direct hot water through the channels. The water must be at a temperature to ensure that thermal energy is channeled away from the engine. The input to the water heater may also be tapped as a source of coolant.

An advantage of the present invention is that preheating guards against premature wear of the rotary engine. Another advantage is that conservation of the fluid is achieved by merely returning the temperature-driven regulating fluid to the source, e.g. a water heater.

BEST MODE FOR CARRYING OUT THE INVENTION

Figure 1:
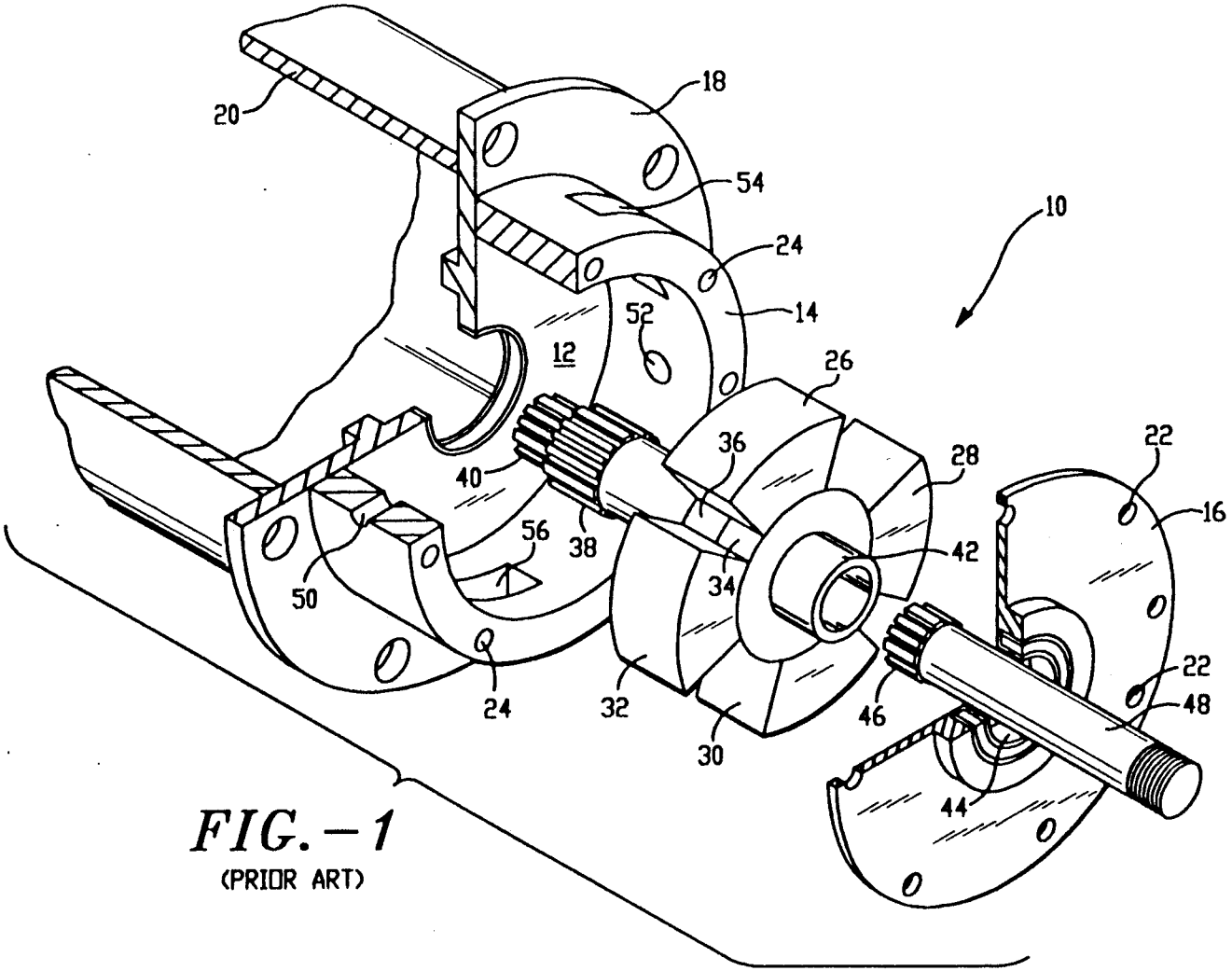
FIG. – 1 (PRIOR ART)
FIG. 1 is a partial prospective view of a prior art rotary engine.

With reference to FIG. 1, a rotary engine 10 includes an engine chamber 12 defined by an annular housing 14 and endplates 16 and 18. The engine 10 is of the type described in U.S. Pat. No. 5,147,191 to Schadeck, which includes a second annular housing 20 that protects a crankshaft and transmission assembly, not shown. Schadeck is incorporated herein by reference.

The forward endplate 16 is fastened to the annular housing 14 by passing bolts through bores 22 in the endplate 16 for tightening into internally-threaded bores 24 in the annular housing. Four pistons, 26, 28, 30 and 32 are supported on adjacent hubs 34 and 36. Two of the pistons 28 and 32 are fastened to the forward hub 34, while the other two pistons 26 and 30 are fastened to the rearward hub 36. A hollow drive shaft 38 is integrally formed with the rearward hub 36, so that rotation of the diametrically opposed pistons 26 and 30 causes rotation of the hollow drive shaft 38. Similarly, an inner drive shaft 40 that extends through the hollow drive shaft 38 is integrally formed with the forward hub 34 for rotation with the diametrically opposed pistons 28 and 32.

Also extending from the forward hub 34 is a tubular member 42 that is received within a bearing assembly 44 at the center of the forward endplate 16. Optionally, a splined end 46 of a shaft 48 can be coupled to the drive shafts 38 and 40 as a means for providing auxiliary power to accessories.

In operation, the engine chamber 12 may be connected to a source of drive fluid, such as steam. For example, a water heater of a major hotel may provide a source of pressurized steam to the engine chamber of the rotary engine 10. However, the drive fluid may be a natural gas outlet or any other source of pressurized fluid. The drive fluid is applied via inlet ports 50 and 52. The pressurized fluid acts upon opposing faces of the pistons 26–32 to urge the pistons in opposite directions from each other. The movement of the pistons is in a limited arc about the axis defined by the drive shafts 38 and 40. Crank assemblies, not shown, within the second annular housing 20 are employed to translate the angular motion over the limited arc to a rotational motion. Cooperative gears then transmit the rotation motion to the drive shafts 38 and 40 for rotation of the pistons 26–32. Drive fluid is exhausted through opposed outlet ports 54 and 56.

The pressurized drive fluid will enter the engine chamber 12 at opposed inlets 50 and 52. For example, if the pistons 26–32 rotate in a counterclockwise direction prior to a power stroke, the pressurized fluid may generate a counterclockwise force against the trailing working surfaces of pistons 28 and 32 to accelerate these pistons, while applying forces to move the other two pistons 26 and 30 in a clockwise direction. The force in the clockwise direction is offset by planetary gears, not shown, within the second annular housing 20. Instead, the pistons 28 and 30 remain essentially motionless during the power stroke.

The outlet ports 54 and 56 are at 120° from the inlet ports 50 and 52 with respect to the counterclockwise direction. Therefore, the pistons 28 and 32 that are connected to the forward hub 34 rotate 120° during the power stroke, exhausting drive fluid through the entire motion. At the termination of the power stroke, all four pistons 26–32 move in a counterclockwise direction over a distance of 30°, thereby positioning the pistons for the subsequent power stroke. The two sets of pistons cooperate throughout operation of the engine 10 to produce a constant rate of rotation at an output.

Figure 2:
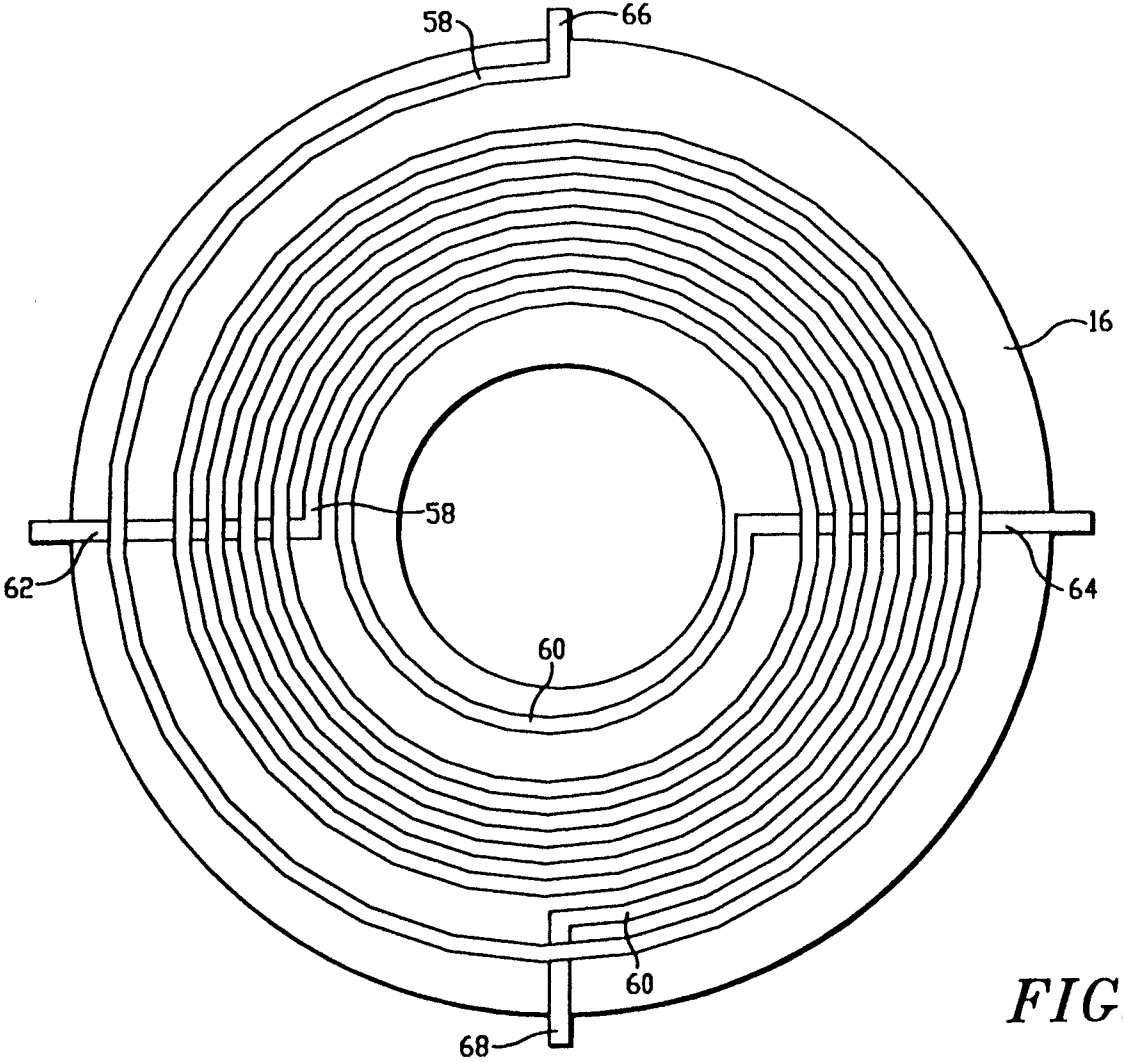
FIG. 2 is an end sectional view of an endplate of FIG. 1 which has been adapted to include scroll patterns for the conduction of preheating and cooling fluid therethrough, in accordance with the present invention.
Figure 3A:
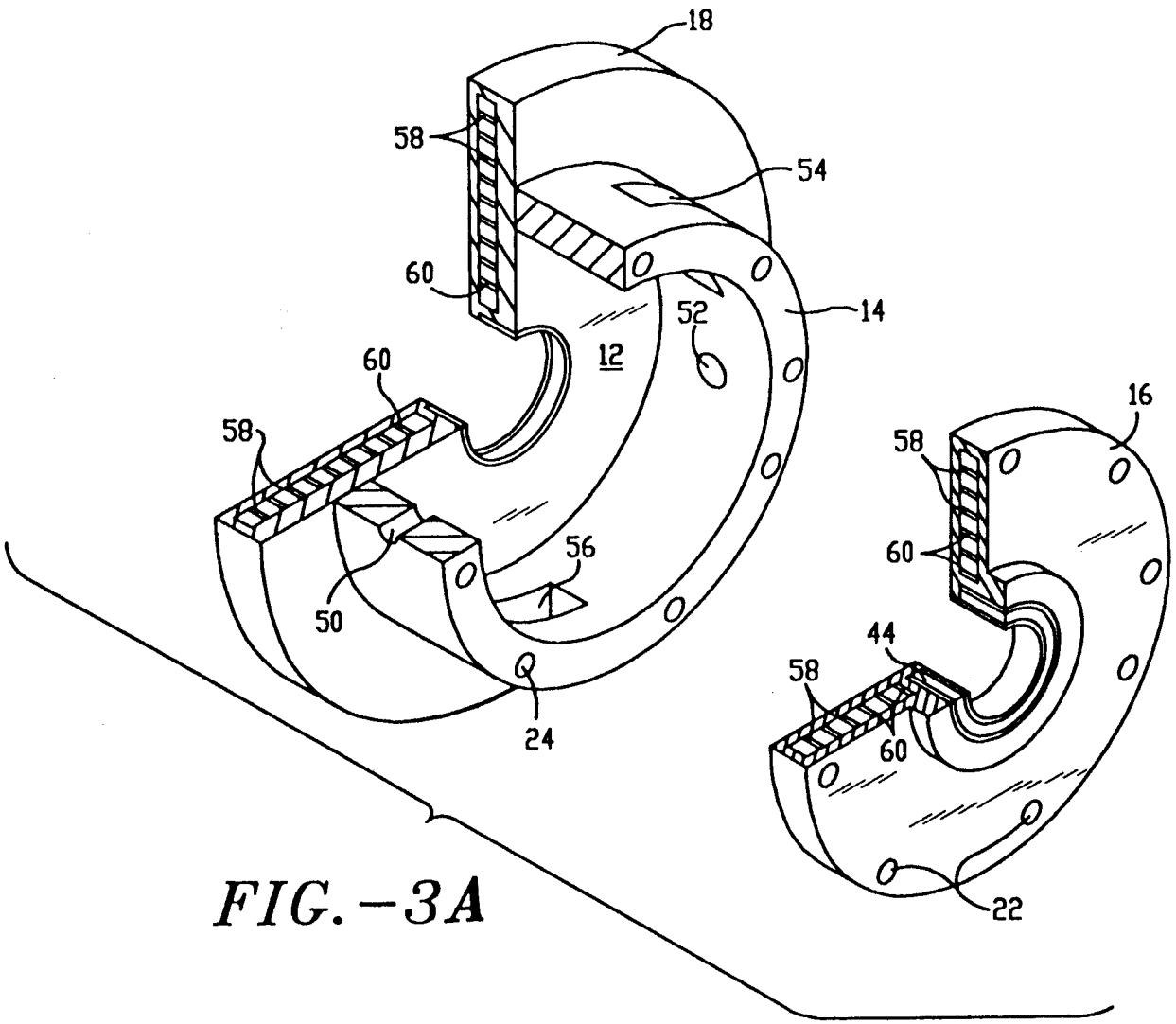
FIGS. 3A and 3B are perspective views of alternative embodiments of the annular housing and endplates of FIG. 1, wherein preheating and cooling channels have been formed in the endplates, in accordance with the present invention.

While the rotary engine 10 operates well for its designed purpose, FIGS. 2 and 3A illustrate a preheating and cooling system for increasing the efficiency of the engine of FIG. 1. Each of the endplate 16 and 18 is provided with a pair of channels 58 and 60 for the circulation of a temperature-regulating fluid. Preferably, the channels have serpentine configurations, with the optimal configuration being a scroll pattern that provides sufficient fluid-to-endplate contact to insure a high degree of thermal conduction from the endplates via the fluid.

In the absence of cooling, the temperature within the engine chamber 12 defined by the annular housing 14 and the endplates 16 and 18 will potentially rise to a level that renders the engine susceptible to premature wear. For example, the bearing assembly 44 may deteriorate prematurely. The scroll patterns, as best seen in FIG. 2, allow entrance of a temperature-regulating fluid at inlets 62 and 64. The fluid will circulate outwardly for release at outlets 66 and 68.

In addition to providing cooling, the flow of fluid through the channels 58 and 60 is used for preheating. Prior to operation of the engine, the temperature-regulating fluid is directed through the channels at an elevated temperature. The preheating reduces the risk of engine freeze-up at initiation of engine operation.

The inlets 62 and 64 of the scroll-shaped channels 58 and 60 are connected to a source of pressurized fluid. Preferably, the temperature-regulating fluid through the channels is the same fluid used to drive the engine. For example, the engine may be steam-driven, with the steam being at least partially condensed and reduced in temperature prior to injection into the channels 58 and 60.

Figure 3B:
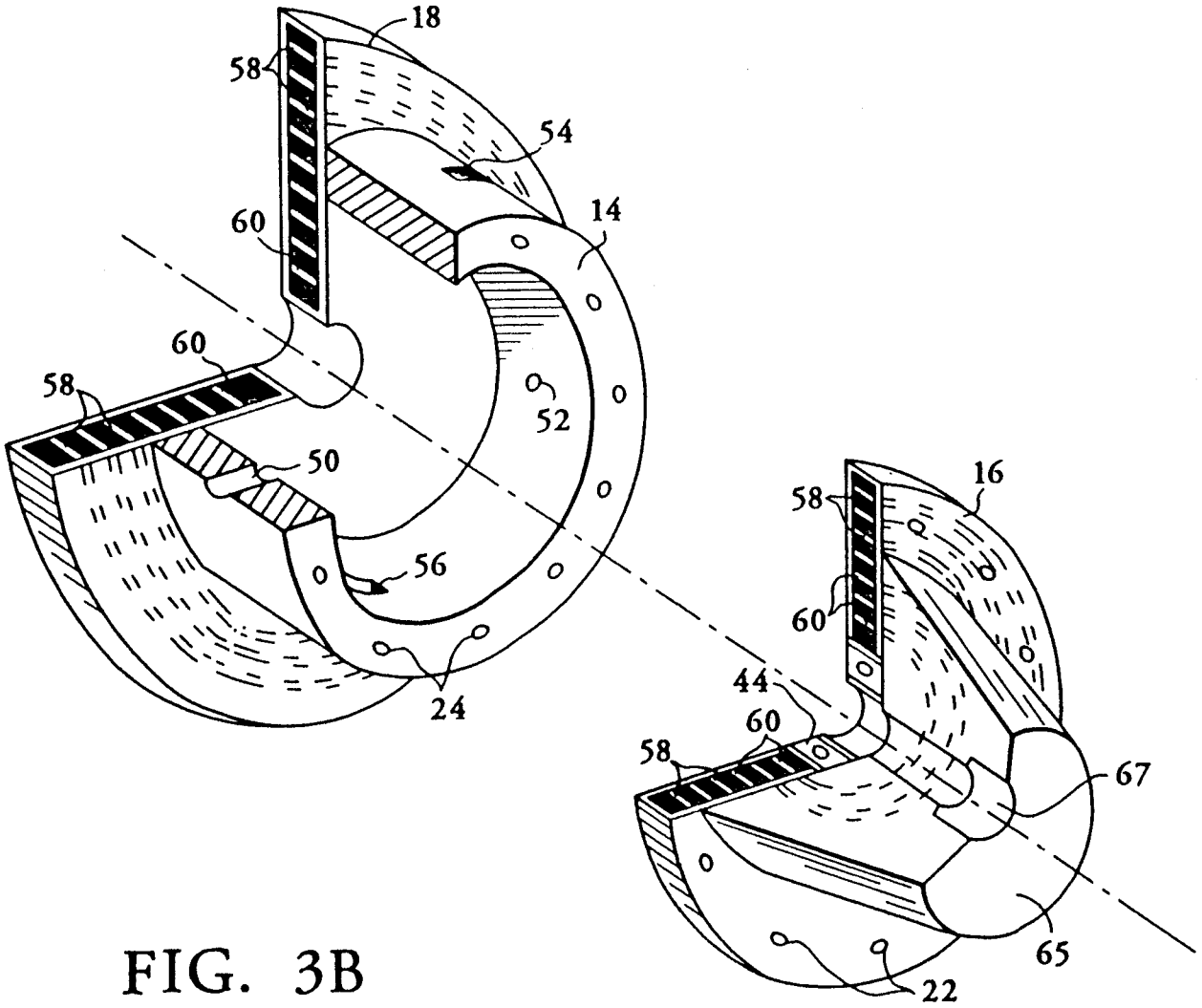

FIG. 3A is a single bearing 44 embodiment of the endplate 16, while FIG. 3B shows a frustroconical shape at a forward end 65 to allow spacing 67 for a second bearing assembly, not shown. The second bearing assembly increases reliability because additional seals may be used at the second bearing assembly. The additional seals help guard against pressure leaks.

A second member may be fixed to the single-bearing embodiment of FIG. 3A so as to allow addition of a second bearing assembly and more seals, but the one-piece structure of FIG. 3B would still be less susceptible to pressure leakage.

Figure 4:
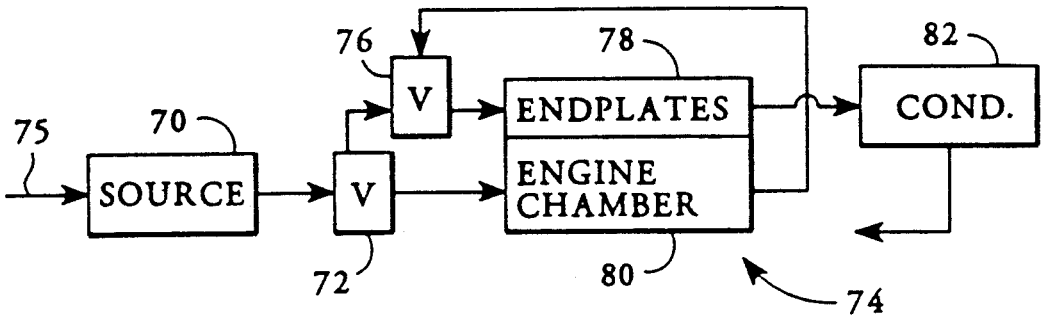
FIGS. 4–7 are block diagrams of different embodiments for providing fluid to the annular housing and endplates of FIG. 3.

FIGS. 4–7 schematically illustrate alternate embodiments for driving and cooling the engine. In FIG. 4, a source 70 of drive fluid is shown connected to a first valve 72. The source 70 may be a water heater of a major hotel, but this is not critical. Alternatively, the source may be an outlet of natural gas or any other means of providing a pressurized fluid for driving an engine 74. If the source is a water heater, a water line 75 supplies water that is heated and furnished to various locations in a hotel or the like. Pressurized steam that is a by-product of the heating process is directed to the first valve 72. During pre-heating, the steam is restricted to a flow path to a second valve 76 that directs the steam to one or more endplates 78 of the engine 74. The flow of the fluid through the endplates raises the temperature of the engine in preparation for operation.

Following preheating, the first and second valve 72 and 76 may be manually or automatically adjusted to redefine the flow path of the steam from the source 70. The first valve 72 opens a path to the engine chamber 80 to begin operation of the engine 74. The operation is defined above, but other rotary engines may be employed in the fluid circuit shown in FIG. 4. The second valve 76 terminates the flow path from the first valve 72 to the endplates 78, and opens a flow path from the exhaust of the engine chamber 80 to the endplates 78. Exhausted fluid from the engine chamber is at a temperature that is significantly reduced relative to the steam entering the engine chamber. Thus, the fluid that is used to drive the engine is also used to cool the engine. Steam that exits from the endplates is received at a condenser 82. Optimally, the condenser is in fluid communication with the source 70, thereby providing a return path for the fluid from the source.

Figure 5:
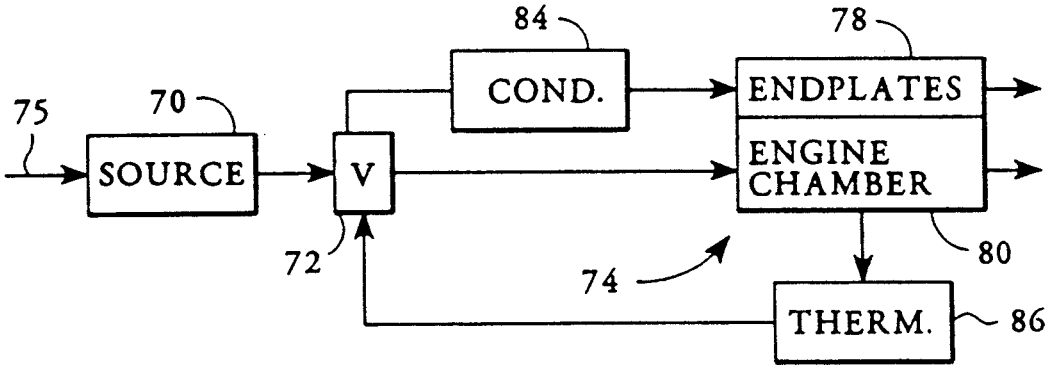

In FIG. 5, the endplates 78 are still connected to the fluid source 70 via a first valve 72, but a condenser 84 replaces the second valve. During preheating, the condenser 84 may be operated to provide a free flow of steam from the source 70 to the endplates 78, but the condenser should be capable of reducing the temperature of the steam during normal operation of the engine 74.

A thermostat 86 is thermally coupled to the engine 74 to monitor the temperature of the engine. The thermostat may then be connected to a control device for regulating the temperature at the engine chamber 80. For example, a rise in the temperature above a desired range may trigger an adjustment of the valve 72 to increase the flow of coolant through the condenser 84 and the endplates 78. In like manner, the detection of a temperature below a desired range can trigger an adjustment of the valve 72 to reduce the flow rate through the endplates 78. At the fluid outlets of the endplates 78 and the engine chamber 80, conservation may be promoted by providing a return path to the fluid source 70.

Figure 6:
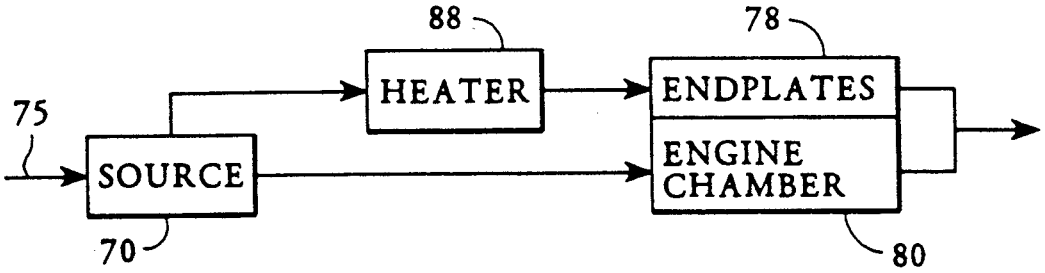

The embodiment of FIG. 6 is one in which the temperature-regulating fluid through the endplates 78 is taken directly from the water line 75 that provides water to the source 70. The water from the line 75 is elevated in temperature at a heater 88. Optionally, a thermostat may be coupled to the engine chamber 80 for selectively adjusting the heater 88 in response to a deviation of the engine chamber temperature from a desired range.

Figure 7:
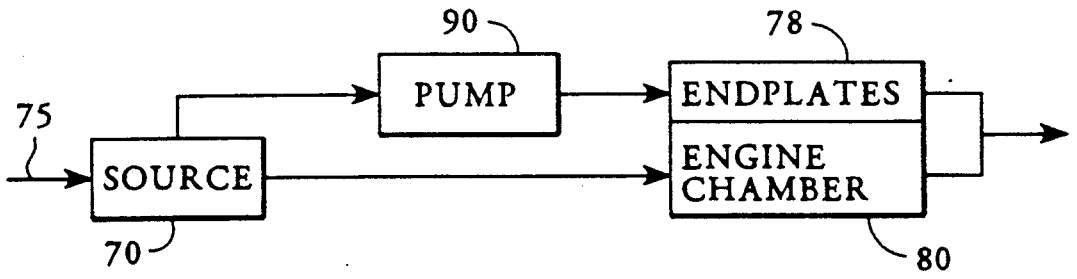

In FIG. 7, the endplates 78 are coupled to receive water from the source 70. A pump 90 directs heated water from the source to the endplates. The pump may be adjusted manually or automatically to maintain a flow rate that achieves the desired preheating and cooling.

Returning to FIGS. 3A and 3B, the endplates 16 and 18 should include fins extending from exterior surfaces to allow the radiation of thermal energy into the surrounding atmosphere. The coolant fins reduce the degree of cooling required by the conduction of temperature-regulating fluid through the channels 58 and 60. Coolant fins may also be added to the exterior surface of the annular housing of the 14.

Figure 8:
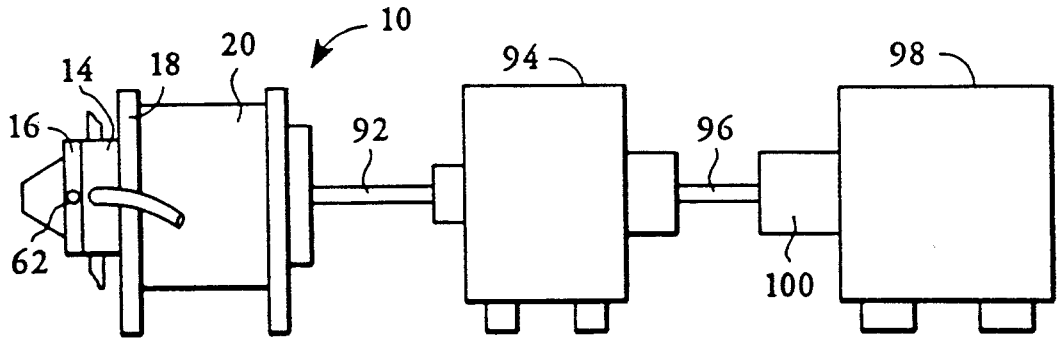
FIG. 8 is a schematic view of a rotary engine coupled to an electrical generator in accordance with the present invention.

In FIG. 8, a drive shaft 92 extending rearwardly from the rotary engine 10 is shown as being connected to a gear multiplier 94. The gear multiplier may be used to provide a greater rate of rotation at a second shaft 96 that is joined to an electrical generator 98. For example, the engine may have a rotational speed of 360 rpm and the gear multiplier 94 may have a one-to-five capacity to drive the second shaft 96 at a rate of 1800 rpm, which is the international standard for electrical generators. A generator adaptor 100 may be necessary in coupling the gear multiplier 94 to the generator 98.

Returning to FIG. 2, the invention is shown as heating and cooling in a radially outward direction. That is, the fluid enters an endplate 16 via inlets 62 and 64 and is directed toward the inside diameter of the endplate, whereafter the flow is generally circular to the outlets 66 and 68. The heating and cooling from the core allows thermal expansion of the endplate to occur in the radially outward direction, thereby reducing the risk of thermal expansion causing engine lock-up by overheating of the bearings.

I claim:

1. A pressurized fluid-driven engine comprising:

a housing having an engine chamber;

inlet means for directing a pressurized drive fluid into said engine chamber;

rotary means disposed within said engine chamber for rotating in response to force of said pressurized drive fluid from said inlet means;

outlet means for exhausting pressurized drive fluid from said engine chamber; and a plate coupled to said housing to define a wall of said engine chamber, said plate having a channel formed therein for the flow of temperature-regulating fluid, said channel having an inlet opening coupled to receive said pressurized drive fluid, wherein said drive fluid provides driving force for said rotary means and provides temperature-regulation;

said channel of said plate being in fluid communication with said outlet means to receive drive fluid exhausted from said engine chamber, thereby providing cooling for said housing, said channel being further in communication with said inlet means to receive pressurized drive fluid for heating said housing.

2. The engine of claim 1 further comprising means for measuring the temperature of said housing and further comprising valve means for controlling the flow of drive fluid to said channel from said inlet means and outlet means, said valve means being responsive to said means for measuring.

3. The engine of claim 1 wherein said inlet means includes a source of steam.

4. The engine of claim 1 wherein said channel of said plate has a serpentine configuration.

5. The device of claim 1 further comprising valve means for regulating the flow of drive fluid from said inlet means and outlet means to said channel of said plate.

6. A pressurized fluid-driven device comprising:

a rotary engine having a plurality of pistons rotatable about a rotational axis, said rotary engine having a fluid drive inlet and having an outlet;

cooling and preheating means for controlling the temperature of said rotary engine, including first and second endplates at opposed sides of said rotary engine, each endplate having a serpentine flow path therethrough; and adjustable means for delivering a temperature-controlled fluid to said serpentine flow paths in response to a condition of said rotary engine, including delivering fluid to preheat said rotary engine prior to initiating rotation of said pistons and including delivering a fluid to cool said rotary engine during rotation of said pistons.

7. The device of claim 6 wherein said serpentine flow paths are each defined by a first scroll-shaped channel within one of said first and second endplates, said first scroll-shaped channel having a plurality of loops disposed along a single plane.

8. The device of claim 7 wherein each of said first scroll-shaped channels has a center generally coincident with said rotational axis of said pistons.

9. The device of claim 7 wherein each of said first and second endplates has a second scroll-shaped channel concentric to said first scroll-shaped channel.

10. The device of claim 6 wherein said rotary engine has an exhaust coupled to said endplates to channel fluid to said serpentine flow paths.

11. The device of claim 10 wherein said rotary engine is a steam engine and said fluid is steam.

12. A steam-driven device comprising:

a source of steam;

a housing having an engine chamber and having a steam inlet;

rotary means in said engine chamber for rotating a shaft in response to the introduction of steam through said steam inlet;

generator means coupled to said shaft for generating electrical power with rotation of said rotary means; and flow path means connected to receive fluid from said source of steam for preheating and cooling said engine chamber, said flow path means being thermally coupled to said housing at opposed sides of said housing.

13. The device of claim 12 wherein said flow path means includes channels in a pair of endplates at said opposed sides of said housing.

14. The device of claim 13 wherein said channels each have a coil-shape within one of said endplates.

15. The device of claim 14 wherein each endplate has a pair of said coil-shaped channels.

16. The device of claim 12 wherein said flow path means is connected to said source of steam via a steam outlet of said housing.

17. A pressurized fluid-driven engine comprising:

a housing having an engine chamber;

inlet means for directing a pressurized drive fluid into said engine chamber;

rotary means disposed within said engine chamber for rotating in response to force of said pressurized drive fluid from said inlet means;

outlet means for exhausting pressurized drive fluid from said engine chamber; and a plate coupled to said housing to define a wall of said engine chamber, said plate having a channel formed therein for temperature regulation, said channel having a serpentine configuration defining a scroll pattern having a plurality of loops within a single plane that is perpendicular to a rotational axis of said rotary means.

* * * * *